US009009878B2

(12) United States Patent
Baines

(10) Patent No.: US 9,009,878 B2
(45) Date of Patent: Apr. 21, 2015

(54) BATH CURTAIN ROD ASSEMBLIES

(75) Inventor: David Baines, Bedford, PA (US)

(73) Assignee: Maytex Mills, Inc., New York, NY (US)

( * ) Notice: Subject to any disclaimer, the term of this patent is extended or adjusted under 35 U.S.C. 154(b) by 796 days.

(21) Appl. No.: 13/293,622

(22) Filed: Nov. 10, 2011

(65) Prior Publication Data

US 2012/0110729 A1 May 10, 2012

Related U.S. Application Data

(60) Provisional application No. 61/412,223, filed on Nov. 10, 2010, provisional application No. 61/448,257, filed on Mar. 2, 2011.

(51) Int. Cl.
*A47K 3/08* (2006.01)
*A47K 3/38* (2006.01)

(52) U.S. Cl.
CPC ..... *A47K 3/38* (2013.01)

(58) Field of Classification Search
CPC ..... A47K 3/38
USPC ..... 4/557–558, 607–608, 610
See application file for complete search history.

(56) References Cited

U.S. PATENT DOCUMENTS

| | | | |
|---|---|---|---|
| 2,813,733 | A | 11/1957 | Herrmann |
| 3,040,902 | A | 6/1962 | Dunn |
| 3,953,138 | A | 4/1976 | Hine et al. |
| 4,585,367 | A | 4/1986 | Gall |
| 4,895,471 | A | 1/1990 | Geltz et al. |
| D324,328 | S | 3/1992 | Pagan |
| D327,421 | S | 6/1992 | Pagan |
| 5,156,281 | A | 10/1992 | Schwartz |
| 5,330,061 | A | 7/1994 | Geltz |
| 5,615,721 | A | 4/1997 | Winter |
| 5,622,446 | A | 4/1997 | Hibberd |
| 5,692,856 | A | 12/1997 | Newman, Jr. et al. |
| 5,894,610 | A | 4/1999 | Winter |
| 6,168,212 | B1 | 1/2001 | Finley |
| D483,251 | S | 12/2003 | Suero, Jr. |
| 6,694,543 | B2 | 2/2004 | Moore |
| 6,715,163 | B1 | 4/2004 | Cunningham |
| D504,310 | S | 4/2005 | Harwanko |
| D522,844 | S | 6/2006 | Harwanko |
| D525,115 | S | 7/2006 | Harwanko |
| D542,897 | S | 5/2007 | Harwanko |

(Continued)

FOREIGN PATENT DOCUMENTS

| | | |
|---|---|---|
| CN | 2349932 Y | 11/1999 |

OTHER PUBLICATIONS

Baines, David M., U.S. Appl. No. 13/605,783 entitled "Gripper Window Rod", filed Sep. 6, 2012.

(Continued)

*Primary Examiner* — Lori Baker
(74) *Attorney, Agent, or Firm* — Alan G. Towner, Esq.; Pietragallo Gordon Alfano Bosick & Raspanti, LLP

(57) ABSTRACT

Bath curtain rod assemblies are disclosed comprising axially movable tubes that may be locked into position in relation with each other. A contact end is extended from one of the tubes to engage and press against a bath support structure to firmly secure the assembly in place. The bath curtain rod assemblies may be installed quickly and easily in bath and shower stalls without the necessity of screws or adhesives.

38 Claims, 5 Drawing Sheets

(56) References Cited

U.S. PATENT DOCUMENTS

| | | | |
|---|---|---|---|
| D586,647 | S | 2/2009 | Didehvar |
| 8,069,507 | B2 | 12/2011 | Didehvar et al. |
| 2008/0163418 | A1 | 7/2008 | Barrese |
| 2008/0282464 | A1 | 11/2008 | Bauer |
| 2008/0295240 | A1 | 12/2008 | Chang |
| 2009/0300838 | A1 | 12/2009 | Didehvar |
| 2012/0005823 | A1 | 1/2012 | Baines |
| 2012/0023657 | A1 | 2/2012 | Didehvar et al. |
| 2012/0152874 | A1 | 6/2012 | Didehvar |
| 2012/0261371 | A1 | 10/2012 | Baines |
| 2013/0099080 | A1 | 4/2013 | Baines |

OTHER PUBLICATIONS

Baines, David M., U.S. Appl. No. 13/723,266 entitled "Curtain Rods", filed Dec. 21, 2012.

BATH CURTAIN ROD ASSEMBLIES

CROSS-REFERENCE TO RELATED APPLICATION

This application claims the benefit of U.S. Provisional Patent Application Ser. No. 61/412,223 filed Nov. 10, 2010 and U.S. Provisional Patent Application Ser. No. 61/448,257 filed Mar. 2, 2011, both of which are incorporated herein by reference.

FIELD OF THE INVENTION

The present invention relates to bath curtain rod assemblies for installation in bath and shower stalls.

BACKGROUND INFORMATION

Bath curtain rods in the market are typically installed by drilling into bathroom walls and using screws to secure the rods, or using adhesives to secure the rods. The bath curtain rod assemblies of the present invention avoid such use of screws and adhesives.

SUMMARY OF THE INVENTION

The present invention provides adjustable bath curtain rod assemblies that can be installed faster and easier than conventional rods.

An aspect of the present invention is to provide a bath curtain rod assembly comprising a first tube, a second tube axially movable with respect to the first tube and lockable into an axial position with respect to the first tube, and an extendable contact end extendably mounted on an end of the first or second tube to engage a support structure.

Another aspect of the present invention is to provide a bath curtain rod assembly comprising means for axially moving first and second tubes of the assembly to a locked position, and means for extending an extendable contact end from at least one of the first and second tubes to press the extendable contact end against a bath structure to thereby secure the bath curtain rod assembly in a desired position.

A further aspect of the present invention is to provide a method of installing a bath curtain rod assembly comprising axially moving first and second tubes of the assembly to a first position, locking the first and second tubes together in the first position, and extending an extendable contact end from at least one of the first and second tubes to press the extendable contact end against a bath structure to thereby secure the bath curtain rod assembly in a desired position.

These and other aspects of the present invention will be more apparent from the following description.

DETAILED DESCRIPTION

Figure 1:
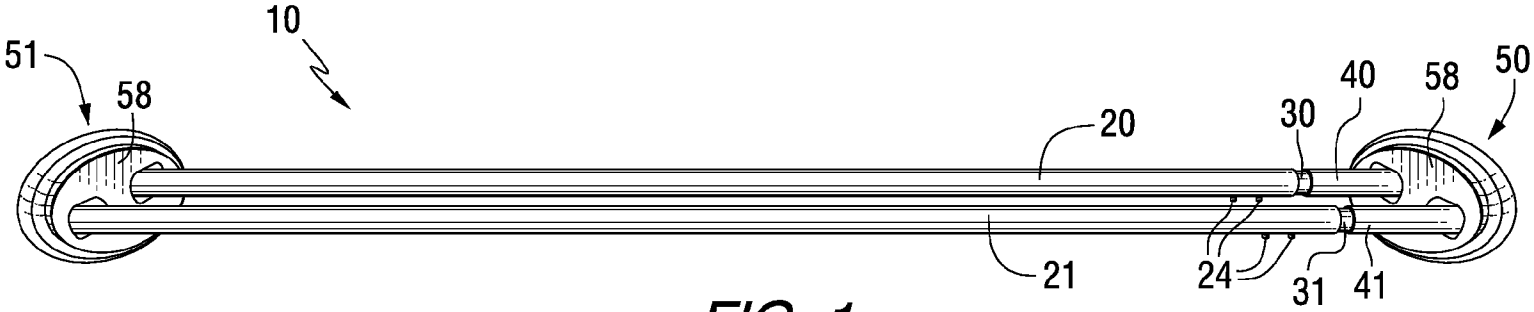
FIG. 1 is a perspective front view of a bath curtain rod assembly in accordance with an embodiment of the present invention having two straight rods.
Figure 2:
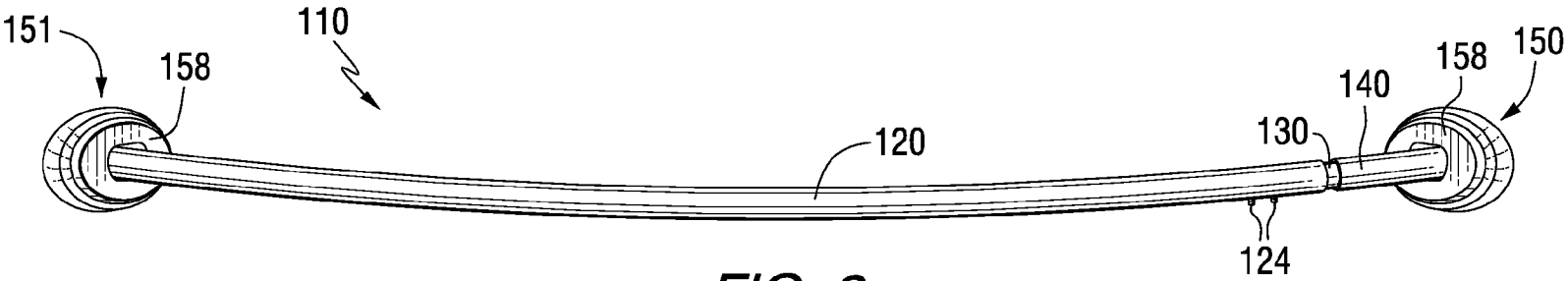
FIG. 2 is a perspective front view of a bath curtain rod assembly in accordance with another embodiment of the present invention having a single curved rod.
Figure 3:
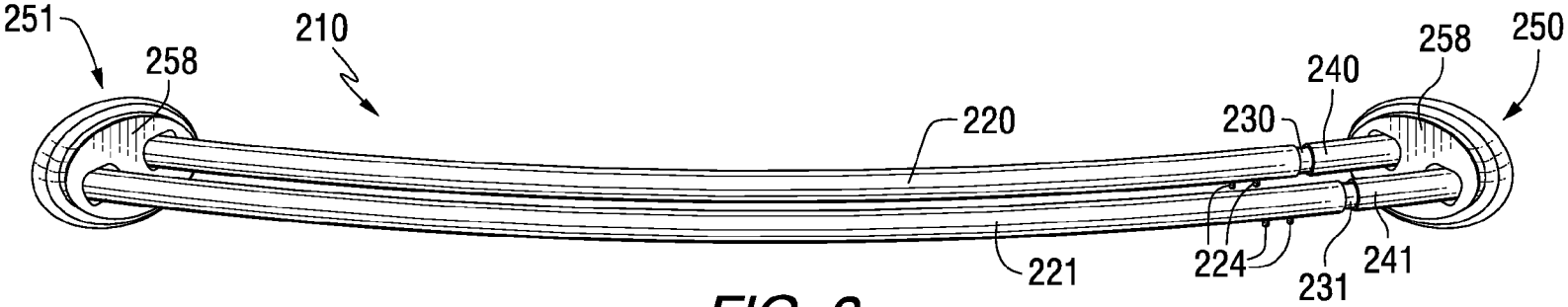
FIG. 3 is a perspective front view of a bath curtain rod assembly in accordance with a further embodiment of the present invention having two curved rods.

FIGS. 1-3 illustrate bath curtain rod assemblies in accordance with embodiments of the present invention. FIG. 1 shows a straight double-rod assembly 10 including two outer tubes 20 and 21 having inner tubes 30 and 31 axially slidable therein. Tightening sleeves 40 and 41 engage ends of the inner tubes 30 and 31, and also engage an extendable contact end 50 of the assembly. A stationary contact end 51 located at the opposite end of the assembly 10 is connected to the outer tubes 20 and 21. End covers 58 are mounted on each of the extendable and stationary contact ends 50 and 51. Allen bolts 24 or other types of mechanical fasteners are used to secure the inner tubes 30 and 31 into selected axial positions with respect to the outer tubes 20 and 21, as more fully described below.

FIG. 2 illustrates a curved single-rod assembly 110 including an outer tube 120 and an inner tube 130 axially slidable therein. A tightening sleeve 140 engages ends of the inner tube 130, and also engages an extendable contact end 150 of the assembly. A stationary contact end 151 located at the opposite end of the assembly 110 is connected to the outer tube 120. End covers 158 are mounted on each of the extendable and stationary contact ends 150 and 151. Mechanical fasteners 124 are used to secure the inner tube 130 into axial position with respect to the outer tube 120.

FIG. 3 illustrates a curved double-rod assembly 210 including two outer tubes 220 and 221 having inner tubes 230 and 231 axially slidable therein. Tightening sleeves 240 and 241 engage ends of the inner tubes 230 and 231, and also engage an extendable contact end 250 of the assembly. A stationary contact end 251 located at the opposite end of the assembly 210 is connected to the outer tubes 220 and 221. End covers 258 are mounted on each of the extendable and stationary contact ends 250 and 251. Mechanical fasteners 224 are used to secure the inner tubes 230 and 231 into axial positions with respect to the outer tubes 220 and 221.

The overall length of the bath curtain rod assemblies 10, 110 and 210 may typically range from 24 to 90 inches. The tubes and other components of the assemblies may be made from any suitable materials, such as corrosion-resistant metals and plastics.

Figure 4:
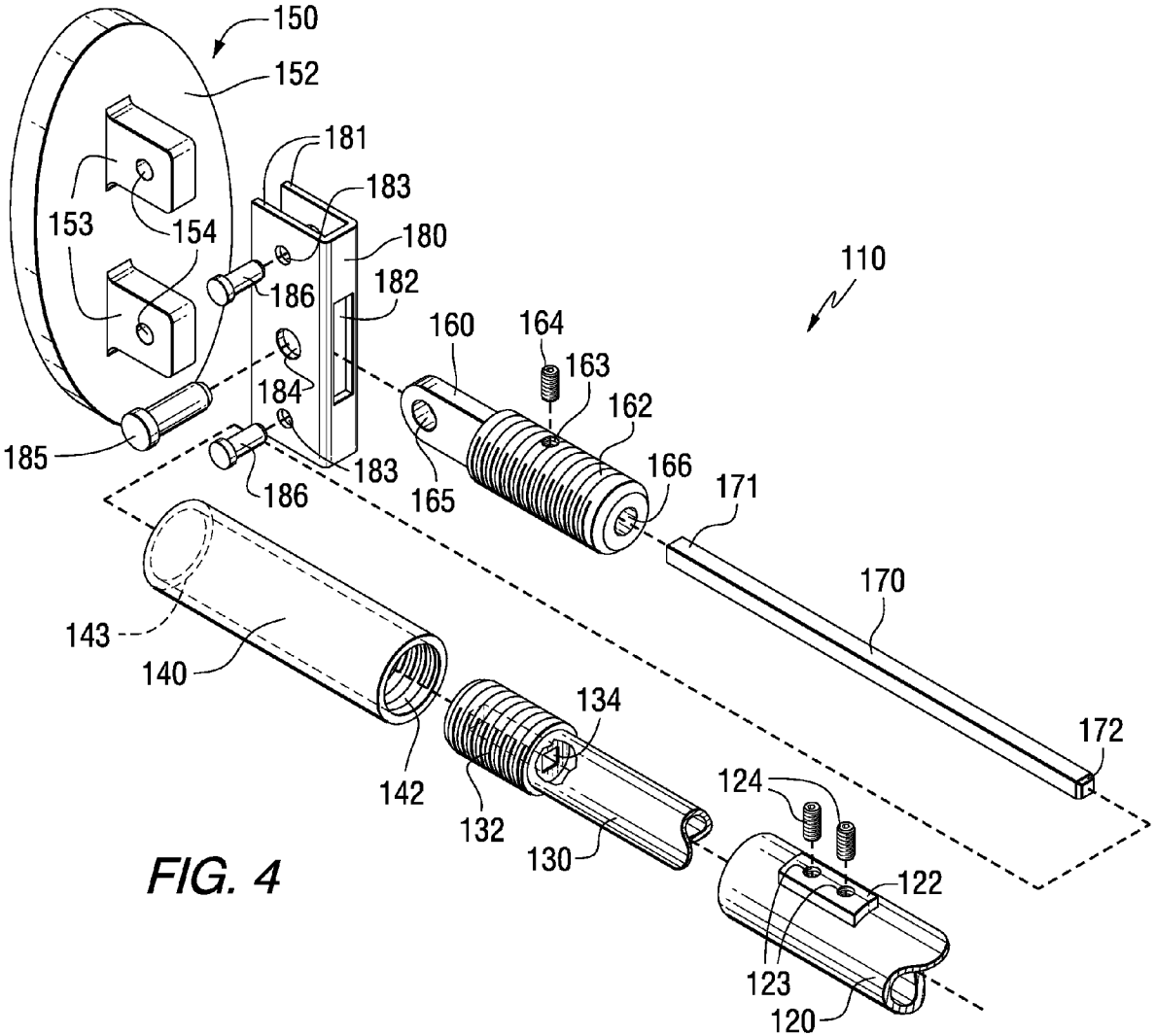
FIG. 4 is an exploded isometric view showing component parts of a bath curtain rod assembly in accordance with an embodiment of the present invention.
Figure 5:
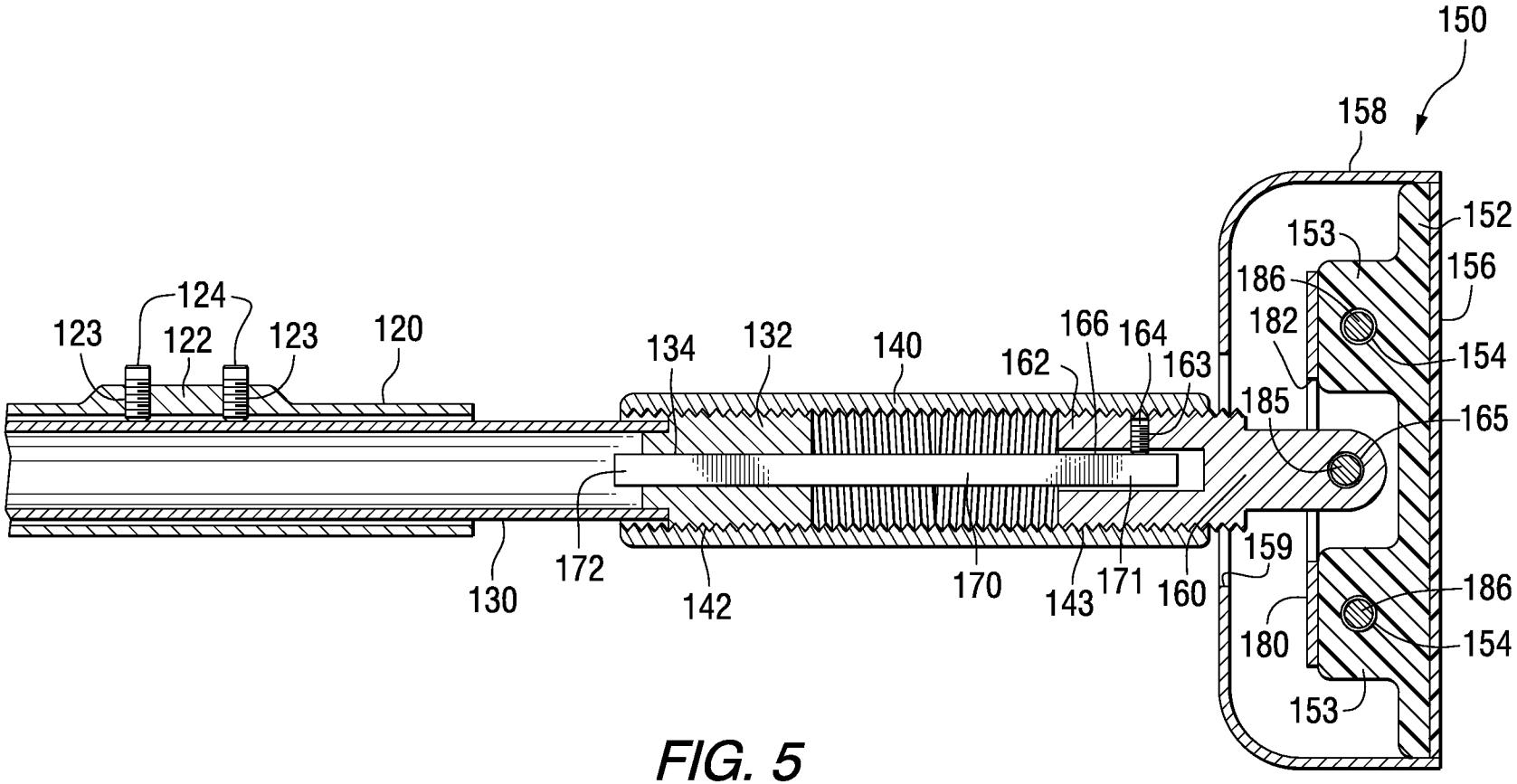
FIG. 5 is a longitudinal sectional view of the bath curtain rod assembly of FIG. 4.

FIG. 4 is an exploded isometric view and FIG. 5 is a longitudinal sectional view illustrating various component parts of a single-rod bath curtain rod assembly 110 similar to that shown in FIG. 2. It is to be understood that, unless specifically described otherwise, the component parts and features described and illustrated in FIGS. 4 and 5 may also be present in double-rod bath rod assemblies of the present invention, such as the double-rod embodiments illustrated in FIGS. 1 and 3.

The bath curtain rod assembly 110 shown in FIGS. 4 and 5 includes an outer tube 120, inner tube 130, tightening sleeve 140 and extendable contact end 150. A stationary contact end 151 as shown in FIG. 2 is mounted at the opposite end of the outer tube 120, but is not shown in FIGS. 4 and 5. In the embodiment shown, the outer tube 120 is generally cylindrical with a circular cross section. However, any other suitable cross-sectional shape may be used, including oval, square, rectangular, hexagonal, octagonal, etc. The tubes may be hollow as shown in the figures, or at least one of the tubes may be solid, e.g., the inner tube 130 may be solid rather than hollow. While the tubes illustrated in the figures are telescoping, any other arrangement that allows relative axial movement may be used, such as tubes positioned side-by-side rather than coaxially. The outer tube 120 may be made of any suitable material such as metal or rigid plastic, for example, a non-corrosive metal such as stainless steel, aluminum, chrome or nickel, or a metal coated with any known type of coating.

The outer tube 120 includes an elevated sidewall portion 122 having a radial thickness greater than the radial thickness of the remainder of the outer tube 120. Threaded holes 123 extended through the elevated sidewall portion 122 into the interior of the outer tube 120. The additional thickness of the elevated sidewall portion 122 provides increased length for the threaded holes 123. Fasteners 124 may be threaded into the holes 123 to lock the inner tube 130 into a desired axial position with respect to the outer tube 120. As used herein, the terms "lock", "locked" and "lockable", when referring to the various inner and outer tubes of the present assemblies, mean that the tubes are held in substantially fixed axial positions with respect to each other. The use of bolts extending through the sidewall of one of the tubes and engaging the outer surface of another tube is primarily described herein. However, any other type of mechanical fastener, latch, frictional engagement, crimping, press fitting, etc. may be used in accordance with the present invention to lock the tubes together. The fasteners 124 are shown in the form of threaded alien bolts, however, it is to be understood that any other suitable type of mechanical fastener could be used.

The inner tube 130 is also generally cylindrical with a circular cross section. The outer diameter of the inner tube 130 is slightly less than the inner diameter of the outer tube 120 in order to provide sufficient clearance to allow the tubes to move axially with respect to each other. An optional cylindrical plastic sleeve or gasket (not shown) may be inserted in the space between the inner and outer tubes 130 and 120 in order to avoid direct contact therebetween and/or in order to provide a seal against water or other liquids entering the space between the tubes. While the inner tube 130 shown in the figures has a circular cross section, any other suitable shape may be used, as described above for the outer tube 120. The inner tube 130 may be made of the same material as the outer tube 120, or a different material.

The inner tube 130 has a threaded end 132 having a square hole 134 extending axially through its center. In the embodiment shown, the threaded end 132 has a larger outer diameter than the outer diameter of the inner tube 130 in order to provide clearance between the outer surface of the inner tube 130 and the inner surface of the tightening sleeve 140. The threaded end 132 may be provided as a separate part, such as a cast and/or machined piece of non-corrosive metal, fastened to the end of the inner tube 130 by any suitable means such as press fitting, crimping, mechanical fasteners, adhesives or the like. However, the threaded end 132 may alternatively be provided as an integral part of the inner tube 130, for example, by cutting threads into the outer diameter of the tube 130 at its end.

The tightening sleeve 140 has interior threads 142 at one end that threadingly engage the threaded end 132 of the inner tube 130. The tightening sleeve 140 also has interior threads 143 at the opposite end that engage a threaded pivot anchor 160, as more fully described below. The interior threads 142 and 143 are provided in different directions such that rotation of the tightening sleeve 140 around its axis either draws the inner tube 130 and anchor 160 toward each other, or away from each other, as more fully described below. The tightening sleeve 140 may be made from the same material as the outer and inner tubes 120 and 130, or a different material.

The extendable contact end 150 comprises a paddle or base 152 with two extended tabs 153. The cover 158 of the extendable contact end 150 is shown in FIG. 5, but has been removed in FIG. 4 in order to more clearly show the other components. Each extended tab 153 includes a hole 154 therethrough for mounting an attachment clip 180. The base 152 and extended tabs 153 may be integrally formed as a single piece of polymeric or other material, or may be provided as separate parts assembled together.

As shown in FIG. 5, the base 152 has a resilient pad 156 attached to its rear surface that contacts a bath or shower stall surface when the assembly is installed. The pad 156, which may be made of natural rubber, synthetic rubber, foam, elastomeric plastic or any other resilient material having a sufficiently high coefficient of friction, facilitates secure mounting of the bath rod assembly in a bath or shower stall while avoiding scratching or other damage to the bath or shower stall. In accordance with embodiments of the invention, the base 152 has a relatively large surface contact area that provides increased holding power when the assembly is installed.

For example, the contact surface area of the base 152 may be at least 2 or 3 times greater than the cross-sectional area of the outer tube 120, typically at least 5 times greater. In certain embodiments, the surface contact area of the base 152 is at least 1 or 2 square inches, typically greater than 5 square inches.

The pivot anchor 160 includes a threaded end 162 engageable in the threaded end 143 of the tightening sleeve 140. A threaded hole 163 extends radially through the threaded end 162 and receives a threaded fastener 164. In the embodiment shown, the threaded fastener 164 is an alien bolt, however, any other suitable type of fastener may be used. At the end of the pivot anchor 164 opposite the threaded end 162, a pivot hole 165 is provided for attachment to the extendable contact end 150, as more fully described below. Another hole 166 extends axially through at least a portion of the threaded end 162. In the embodiment shown, the axial hole 166 is round, however, any other suitable hole shape may be used.

An alignment rod 170 with an anchor-engaging end 171 is inserted in the axial hole 166 of the pivot anchor 160. The alignment rod 170 may be made of any suitable material, such as non-corrosive metal. Tightening of the threaded fastener 164 secures the alignment rod 170 into position with respect to the pivot anchor 160 such that the alignment rod 170 is held against axial and rotational movement with respect to the anchor 160. The alignment rod 170 also has a tube-engaging end 172 that slidingly fits in the hole 134 in the threaded end 132 of the inner tube 130. The alignment rod 170 ensures that the pivot anchor 160 and threaded end 132 of the inner tube 130 are substantially aligned along the same longitudinal axis. Such alignment facilitates relative movement when the tightening sleeve is rotated and the pivot anchor 160 and threaded end 132 are drawn toward or away from each other along their longitudinal axes. In the embodiment shown, the cross sectional shapes of the alignment rod 170 and hole 134 prevent relative rotation between the alignment rod 170 and the inner tube 130. The alignment rod 170 and hole 134 may have square cross sections as shown, however, any other suitable cross sectional shapes may be used that allow the bar 170 to slide along its longitudinal axis inside the hole 134 of the inner tube 130.

As shown most clearly in FIG. 4, the attachment clip 180 is generally channel-shaped with two sides 181. The attachment clip 180 may be made of any suitable material such as non-corrosive metal. A slot 182 is provided through the attachment clip 180 to allow the end of the pivot anchor 160 to pass therethrough. Two mounting holes 183 are provided through the attachment clip 180, as well as a central pivot hole 184. A pivot pin 185 passes through the sides 181 of the clip 180, as well as through the pivot hole 165 of the pivot anchor 160. The pivot anchor 160 is thus secured to the attachment clip 180 while allowing a certain degree of pivotal movement around the pivot pin 185. The slot 182 is of sufficient size to allow a desired amount of pivoting movement of the pivot anchor 160. The attachment clip 180 is secured to the extendable contact end 150 by mounting pins 186 extending through the mounting holes 183 of the clip 180, as well as through the holes 154 of the extended tabs 153. While the mounting pins 186 are shown as rivets in FIGS. 4 and 5, any other suitable type of mechanical fastener may be used.

In accordance with embodiments of the invention, the use of extended tabs 153 or other mounting fixtures that are separated from each other on a relatively wide base 152 spreads out the pressing force when the assemblies are installed in a bath or shower stall. The distance between the extended tabs 153, as measured between the centers of the holes 154 shown in FIG. 5, is typically greater than the outer diameter of the outer tube 120, and may be more than 1.5 or 2 times greater. Such separation spreads out the pressing force against the bath or shower stall, and prevents or reduces rotation of the assembly during installation. Furthermore, the contact ends 150 and 151 have relatively large contact areas or footprints, which reduce the force per unit surface area, e.g., as measured in pounds per square inch (psi). The use of a resilient material having a relatively high coefficient of friction on the contact surfaces of the contact ends 150 and 151, such as the resilient pad 156, further reduces potential slippage of the assembly due to frictional resistance over a relatively large contact surface.

Although the stationary contact end 151 mounted on the opposite end of the outer tube 120 is not shown in FIG. 4 or 5, it is to be understood that the structure and features of the stationary contact end 151 may be similar to that of the extendable contact end 150, except the pivot anchor 160 may be attached directly into the end of the outer tube 120 adjacent to the stationary contact end 151. The stationary contact end 151 may thus include the same or similar base 152 and attachment clip 180 as used in the extendable contact end 150. The base of the stationary contact end 151 may also have the same or similar dimensions as the base 152 of the extendable contact end 150, and may be provided with a resilient pad 156 as described above.

Figure 6:
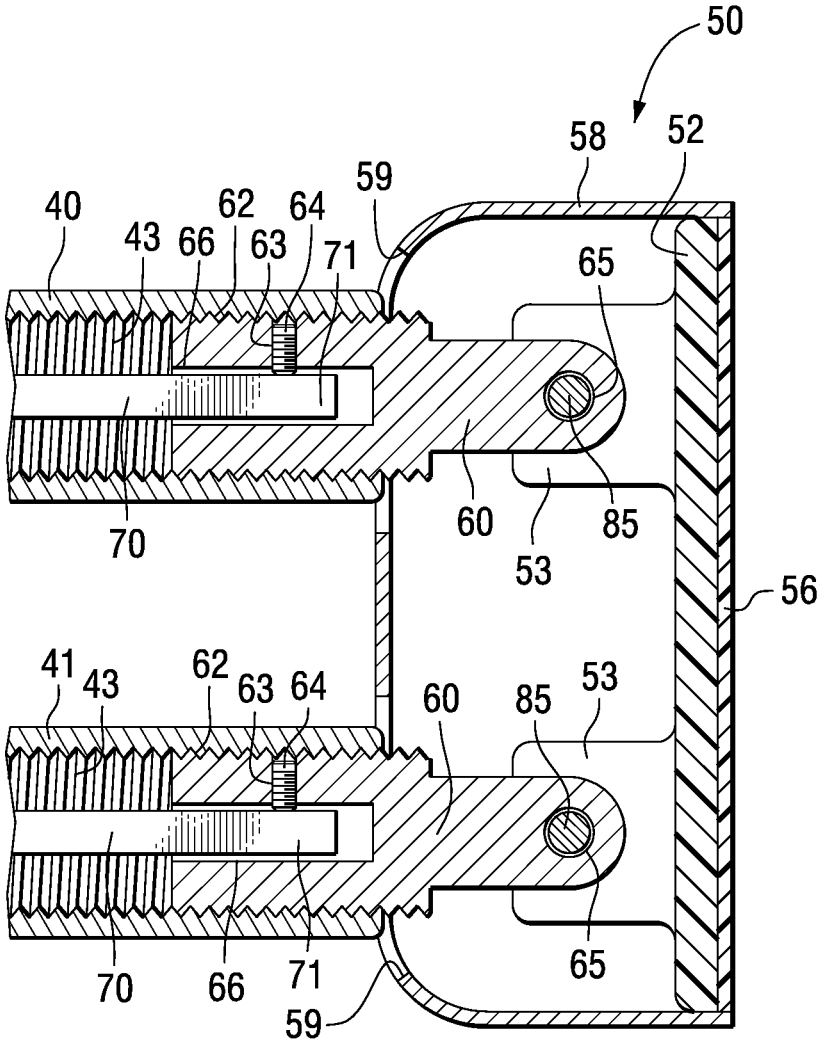
FIG. 6 is a longitudinal sectional view of a portion of a bath curtain rod assembly in accordance with an embodiment of the present invention.

FIG. 6 is a longitudinal sectional view of a portion of a dual-rod assembly similar to the embodiments shown in FIGS. 1 and 3. The bath curtain rod assembly 50 includes a base 52 with two extended tabs 53. Instead of using an attachment clip 180 as shown in the embodiment of FIGS. 4 and 5, the embodiment shown in FIG. 6 provides direct pivotal attachment between each of the extended tabs 53 and its respective anchor 60. In this embodiment, each extended tab 53 comprises two segments with a space therebetween sufficient for the end of the anchor 60 with its pivot hole 65 to be inserted therebetween. A pivot pin 85 extending between the sections of the extended tabs 53 and through the pivot hole 65 of the anchor 60 is used to pivotally mount the anchor 60 onto the base 52, while allowing limited pivotal movement therebetween. In the embodiment shown in FIG. 6, both of the anchors 60 are pivotally mounted to the extending tabs 53 in the same manner, and a resilient pad 56 is attached to the base 52. As described with respect to the embodiment of FIGS. 4 and 5 above, the use of a relatively large base 52 and spaced apart extended tabs 53 spreads out the pressing force and provides increased friction that holds the assembly firmly in position.

In the embodiment shown in FIG. 6, the interiorly threaded tightening sleeve 40 engages the anchor 60 in the same manner as the tightening sleeve 140 engages the anchor 160 in the embodiment of FIGS. 4 and 5. Similarly, the second internally threaded tightening sleeve 41 engages its respective anchor 60 in the same manner. Alignment rods 70 with anchor-engaging ends 71 are inserted in axial holes 66 extending partially through each anchor 60. A threaded hole 63 in each anchor 60 receives a threaded fastener 64 for securing each alignment rod 70 against axial and rotational movement with respect to each anchor 60. Each of the tightening sleeves 40 and 41 include threads 43 engaging corresponding threads 62 of the anchor 60. The alignment rods facilitate operation of the tightening sleeves 40 and 41 by axially aligning them with their respective anchors 60. Although the extendable contact end 50 shown in FIG. 6 corresponds to the dual-rod embodiment shown in FIG. 1, it is to be understood that the same or similar extendable contact end arrangement may be used in the embodiment shown in FIG. 3.

Figure 7:
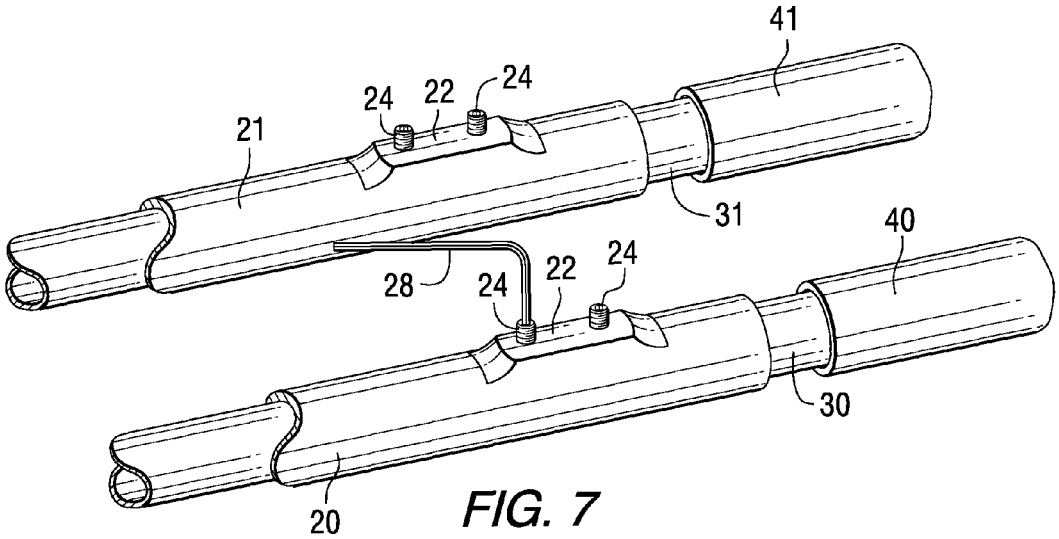
FIGS. 7-9 illustrate installation steps for a bath curtain rod assembly in accordance with an embodiment of the present invention.
Figure 8:
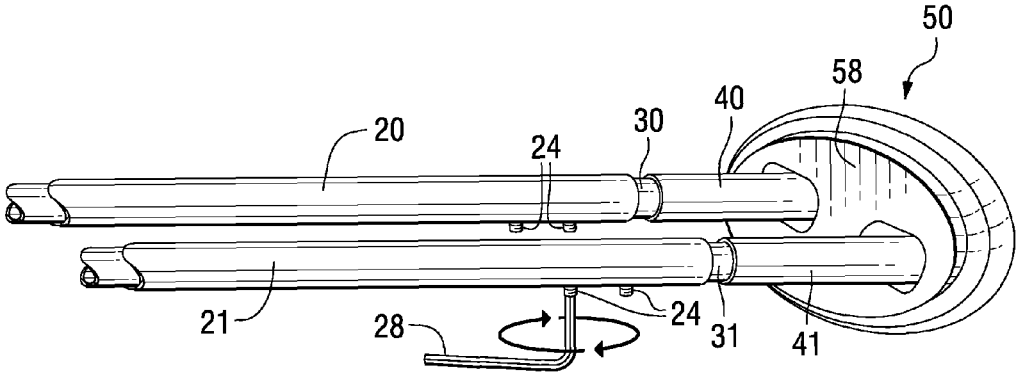
Figure 9:
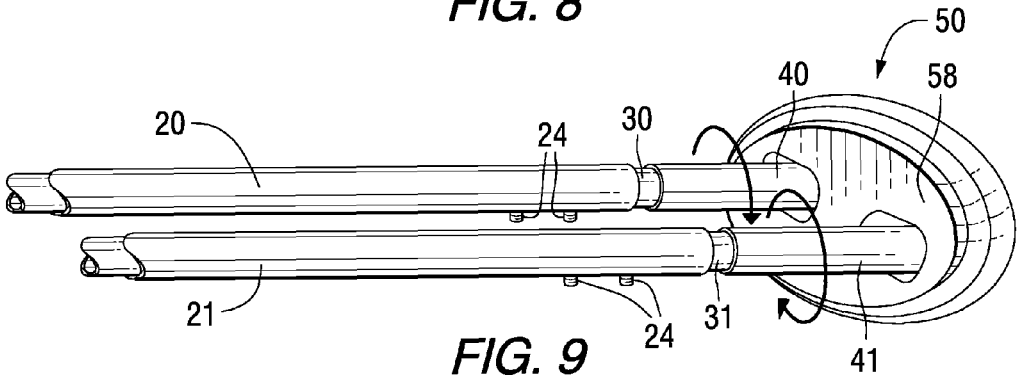

FIGS. 7-9 illustrate sequential installation steps that may be followed when installing bath curtain rod assemblies of the present invention in a bath or shower stall (not shown). The installation steps are described for dual-rod assemblies, such as shown in FIGS. 1 and 3, however, similar installation steps may be followed for single-rod assemblies.

In FIG. 7, an alien wrench 28 is used to loosen the threaded fasteners 24 on the outer tube 20 in order to allow the inner tube 30 to axially move in relation to the outer tube 20. Similar loosening of the threaded fasteners 24 on the outer tube 21 allows the inner tube 31 to axially move with respect to the outer tube 21. The inner tubes 30 and 31 are this free to telescope in relation to their respective outer tubes 20 and 21.

After the fasteners 24 are loosened as shown in FIG. 7, the bath curtain rod assembly may be flipped over so the threaded fasteners 24 are pointing downward, as shown in FIG. 8. In this position, each of the inner tubes 30 and 31 may be extended axially from their respective outer tubes 20 and 21 into positions in which the extendable contact end 50 and stationary contact end 51 are positioned adjacent to the wall or other support structure of the bath or shower stall. Thus, the contact ends 50 and 51 will be in contact with, or positioned very close to, the support structure. Once in position, as shown in FIG. 8, the allen wrench 28 is used to tighten the threaded fasteners 24 to secure the inner tubes 30 and 31 in fixed positions with respect to their corresponding outer tubes 20 and 21. Alternatively, the length of the bath or shower stall may be measured first, and the inner tubes 30 and 31 may be moved and locked into positions approximating the measured length before the assembly is moved into position in the bath or shower stall.

Next, as shown in FIG. 9, the tightening sleeves 40 and 41 are rotated in the directions shown by the arrows to extend the extendable contact end 50 from the inner tubes 30 and 31. In this manner, the extendable contact end 50 presses against the bath or shower stall support structure in order to firmly secure the bath curtain rod assembly in the desired position.

Thus, in accordance with embodiments of the present invention, by using axially movable tubes, the rod assemblies are extended so that the contact members at the ends of the tubes are placed in their desired positions. Allen bolts or other mechanical fasteners are used to fix the relative axial positions of the tubes. The non-slip contact members may grip the walls in this position. At least one tightening sleeve is then rotated to apply additional force to hold the assembly firmly in place. In accordance with embodiments of the invention, the tightening sleeve(s) are rotated by hand without the use of tools.

The assemblies are capable of withstanding significant loads. For example, when a single-rod assembly as shown in FIG. 2 is subjected to load testing on tile walls, with a distance between walls of 72 inches, it is found to hold 30 pounds, while the same test conducted with sheetrock walls yields 44 pounds. When a curved double-rod assembly as shown in FIG. 3 is subjected to load testing on various types of walls, the following average loads are achieved: textured tile surface—66 pounds; textured sheetrock surface—28 pounds; marble surface—90 pounds; fiberglass shower board surface—69 pounds, for an overall average of 63 pounds. When a straight double-rod assembly as shown in FIG. 1 is subjected to load testing on various types of walls, the following average loads are achieved: textured tile surface—99 pounds; textured sheetrock surface—106 pounds; marble surface—118 pounds; fiberglass shower board surface—125 pounds, for an overall average of 112 pounds.

The adjustable bath curtain rods of the present invention provide several benefits. They may be installed in little time without drilling or adhesives, and there is no risk of drilling holes in the wrong place. Rather than being permanently installed, the assemblies are easily removable and can be repositioned at any time.

Whereas particular embodiments of this invention have been described above for purposes of illustration, it will be evident to those skilled in the art that numerous variations of the details of the present invention may be made without departing from the invention as defined in the appended claims.

The invention claimed is:

1. A bath curtain rod assembly comprising:

a first tube comprising at least one threaded hole extending through a sidewall of the first tube;

a second tube telescopingly received in the first tube, axially movable with respect to the first tube, and lockable into an axial position with respect to the first tube;

at least one mechanical fastener threadingly engaged with the threaded hole of the first tube and engageable with an outer surface of the second tube to thereby lock the second tube into the axial position with respect to the first tube; and an extendable contact end extendably mounted on an end of the first or second tube comprising a resilient pad mounted thereon to engage a bath support structure to thereby secure the bath curtain rod assembly on the bath support structure by frictional engagement between the resilient pad and the bath support structure.

2. The bath curtain rod assembly of claim 1, wherein the extendable contact end is mounted on a distal end of the second tube.

3. The bath curtain rod assembly of claim 2, further comprising a stationary contact end mounted on a distal end of the first tube.

4. The bath curtain rod assembly of claim 3, wherein the extendable contact end is pivotally mounted on the distal end of the second tube, and the stationary contact end is pivotally mounted on the distal end of the first tube.

5. The bath curtain rod assembly of claim 1, wherein the extendable contact end comprises a base having a rear surface structured and arranged to engage the bath support structure, and a front face comprising at least one extended tab thereon coupled to the second tube.

6. The bath curtain rod assembly of claim 5, comprising at least two of the extended tabs.

7. The bath curtain rod assembly of claim 6, further comprising an attachment clip mounted on the extended tabs coupled to the second tube.

8. The bath curtain rod assembly of claim 1, further comprising a tightening sleeve coupled to the second tube and the extendable contact end.

9. The bath curtain rod assembly of claim 8, wherein the tightening sleeve comprises interior threads adjacent a first end thereof engaging a threaded portion of the second tube.

10. The bath curtain rod assembly of claim 9, wherein the tightening sleeve further comprises interior threads adjacent a second end thereof for engaging a threaded anchor coupled to the extendable contact end.

11. The bath curtain rod assembly of claim 10, wherein the interior threads adjacent the first and second ends of the tightening sleeve are threaded in different directions, rotation of the tightening sleeve around a longitudinal axis thereof extends the extendable contact end away from the second tube, and rotation of the tightening sleeve around the longitudinal axis in an opposite direction draws the extendable contact end toward the second tube.

12. The bath curtain rod assembly of claim 10, wherein the threaded anchor is pivotally mounted on a base of the extendable contact end.

13. The bath curtain rod assembly of claim 10, further comprising an alignment rod engaging the threaded anchor and an end of the second tube.

14. The bath curtain rod assembly of claim 13, wherein the alignment rod is secured in a fixed position with respect to the threaded anchor and is slidable along a longitudinal axis of the second tube.

15. The bath curtain rod assembly of claim 14, wherein the second tube comprises a threaded end with a central hole extending in a longitudinal axial direction, and a portion of the alignment rod is located in the central hole.

16. The bath curtain rod assembly of claim 15, wherein the central hole and alignment rod have cross-sectional shapes that substantially prevent relative rotation between the alignment rod and the second tube in a direction parallel with the longitudinal axial direction.

17. The bath curtain rod assembly of claim 1, wherein the first and second tubes are substantially straight.

18. The bath curtain rod assembly of claim 1, wherein the first and second tubes are curved.

19. The bath curtain rod assembly of claim 1, further comprising:

a third tube; and a fourth tube axially movable with respect to the third tube and lockable into an axial position with respect to the third tube, wherein the extendable contact end is mounted on distal ends of the second and fourth tubes.

20. The bath curtain rod assembly of claim 19, further comprising a stationary contact end mounted on distal ends of the first and third tubes.

21. The bath curtain rod assembly of claim 20, wherein the second and fourth tubes are pivotally mounted on the extendable contact end, and the first and third tubes are pivotally mounted on the stationary contact end.

22. The bath curtain rod assembly of claim 19, wherein the extendable contact end comprises a base having a rear surface structured and arranged to engage the bath support structure, and a front face comprising a first extended tab thereon coupled to the second tube and a second extended tab thereon coupled to the fourth tube.

23. The bath curtain rod assembly of claim 19, further comprising a first tightening sleeve coupled to the second tube, and a second tightening sleeve coupled to the fourth tube.

24. The bath curtain rod assembly of claim 23, wherein the first tightening sleeve comprises interior threads engaging a first threaded anchor coupled to the extendable contact end, and the second tightening sleeve comprises interior threads engaging a second threaded anchor coupled to the extendable contact end.

25. The bath curtain rod assembly of claim 24, wherein rotation of the first tightening sleeve around a longitudinal axis thereof extends the extendable contact end away from the second tube, and rotation of the second tightening sleeve around a longitudinal axis thereof extends the extendable contact end away from the fourth tube.

26. The bath curtain rod assembly of claim 25, further comprising a first alignment rod engaging the first threaded anchor and an end of the second tube, and a second alignment rod engaging the second threaded anchor and an end of the fourth tube.

27. The bath curtain rod assembly of claim 26, wherein the first alignment rod is secured in a fixed position with respect to the first threaded anchor and is slidable along a longitudinal axis of the second tube, and the second alignment rod is secured in a fixed position with respect to the second threaded anchor and is slidable along a longitudinal axis of the fourth tube.

28. The bath curtain rod assembly of claim 27, wherein the second tube comprises a threaded end with a central hole extending in a longitudinal axial direction, and a portion of the first alignment rod is located in the central hole.

29. The bath curtain rod assembly of claim 28, wherein the central hole and first alignment rod have cross-sectional shapes that substantially prevent relative rotation between the first alignment rod and the second tube in a direction parallel with the longitudinal axial direction.

30. The bath curtain rod assembly of claim 19, wherein the first, second, third and fourth tubes are substantially straight.

31. The bath curtain rod assembly of claim 19, wherein the first, second, third and fourth tubes are curved.

32. The bath curtain rod assembly of claim 1, further comprising a cover attached to a base of the extendable contact end and having at least one opening facing the second tube.

33. A bath curtain rod assembly comprising:

means for axially moving first and second tubes of the assembly to a locked position comprising at least one mechanical fastener threadingly engaged with a threaded hole extending through a sidewall of the first tube and engageable with an outer surface of the second tube to thereby lock the second tube into the axial position with respect to the first tube; and means for extending an extendable contact end from at least one of the first and second tubes to press a resilient pad mounted on the extendable contact end against a bath support structure to thereby secure the bath curtain rod assembly in a desired position by frictional engagement between the resilient pad and the bath support structure.

34. A method of installing a bath curtain rod assembly comprising:

axially moving first and second tubes of the assembly to a first position;

locking the first and second tubes together in the first position with at least one mechanical fastener threadingly engaged with a threaded hole extending through a sidewall of the first tube that engages an outer surface of the second tube; and extending an extendable contact end having a resilient pad mounted thereon from at least one of the first and second tubes to press the resilient pad of the extendable contact end against a bath support structure to thereby secure the bath curtain rod assembly in a desired position by frictional engagement between the resilient pad and the bath support structure.

35. The bath curtain rod assembly of claim 1, wherein the at least one mechanical fastener is an allen bolt.

36. The bath curtain rod assembly of claim 1, comprising two of the threaded holes extending through the sidewall of the first tube, and two of the mechanical fasteners threadingly engaged with the threaded holes.

37. The bath curtain rod assembly of claim 1, wherein the resilient pad comprises a contact surface having a surface area at least 5 times greater than a cross-sectional area of the outer tube.

38. The bath curtain rod assembly of claim 3, wherein the stationary contact end comprises a resilient pad mounted thereon to engage the bath support structure to thereby secure the bath curtain rod assembly on the bath support structure by frictional engagement between the resilient pad of the stationary contact end and the bath support structure.

* * * * *